US009311850B2

(12) United States Patent
Lee et al.

(10) Patent No.: US 9,311,850 B2
(45) Date of Patent: Apr. 12, 2016

(54) PIXEL FOR MINIMIZING POWER CONSUMPTION AND ORGANIC LIGHT EMITTING DISPLAY USING THE SAME

(71) Applicant: Samsung Display Co., Ltd., Yongin, Gyeonggi-do (KR)

(72) Inventors: Wook Lee, Yongin (KR); Jeong-Hwan Shin, Yongin (KR); Se-Byung Chae, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 222 days.

(21) Appl. No.: 13/666,300

(22) Filed: Nov. 1, 2012

(65) Prior Publication Data

US 2014/0022226 A1 Jan. 23, 2014

(30) Foreign Application Priority Data

Jul. 19, 2012 (KR) ..... 10-2012-0078788

(51) Int. Cl.
*G09G 3/30* (2006.01)
*G09G 3/32* (2006.01)

(52) U.S. Cl.
CPC ..... *G09G 3/3233* (2013.01); *G09G 2300/0819* (2013.01); *G09G 2300/0842* (2013.01); *G09G 2300/0861* (2013.01); *G09G 2330/021* (2013.01); *G09G 2340/0435* (2013.01)

(58) Field of Classification Search
CPC ..... G09G 3/12–3/14; G09G 3/32–3/3291; G09G 2310/0243–2310/0297
USPC ..... 345/36, 45, 76–82
See application file for complete search history.

(56) References Cited

U.S. PATENT DOCUMENTS

| | | | | |
|---|---|---|---|---|
| 2004/0080475 | A1* | 4/2004 | Yoshida | 345/82 |
| 2004/0183791 | A1* | 9/2004 | Yoshida et al. | 345/204 |
| 2009/0073093 | A1* | 3/2009 | Yamazaki | 345/76 |
| 2010/0277401 | A1* | 11/2010 | Takahara et al. | 345/76 |
| 2011/0109598 | A1* | 5/2011 | Oh | 345/204 |
| 2011/0227908 | A1* | 9/2011 | Choi | 345/215 |

FOREIGN PATENT DOCUMENTS

| | | | |
|---|---|---|---|
| KR | 10-0573160 | B1 | 4/2006 |
| KR | 10-2007-0105191 | A | 10/2007 |
| KR | 10-1056303 | B1 | 8/2011 |
| KR | 10-2011-0121889 | A | 11/2011 |

* cited by examiner

*Primary Examiner* — Sanghyuk Park
(74) *Attorney, Agent, or Firm* — Knobbe, Martens, Olson & Bear, LLP

(57) ABSTRACT

A pixel capable of minimizing power consumption is disclosed. In one embodiment, the pixel includes an organic light emitting diode (OLED), a first transistor for controlling an amount of current supplied from a first power supply to the OLED to correspond to a voltage applied to a first node, and a second transistor and a third transistor coupled between a second node electrically coupled to a data line and the first node in parallel in a period where a scan signal is supplied.

20 Claims, 3 Drawing Sheets

PIXEL FOR MINIMIZING POWER CONSUMPTION AND ORGANIC LIGHT EMITTING DISPLAY USING THE SAME

CROSS-REFERENCE TO RELATED APPLICATION

This application claims priority to and the benefit of Korean Patent Application No. 10-2012-0078788, filed on Jul. 19, 2012, in the Korean Intellectual Property Office, the entire content of which is incorporated herein by reference.

BACKGROUND

1. Field

The described technology generally relates to a pixel and an organic light emitting display using the same, and more particularly, to a pixel capable of minimizing power consumption and an organic light emitting display using the same.

2. Description of the Related Technology

Recently, various flat panel displays (FPD) capable of reducing weight and volume that are disadvantages of cathode ray tubes (CRT) have been developed. The FPDs include liquid crystal displays (LCD), field emission displays (FED), plasma display panels (PDP), and organic light emitting displays.

Among the FPDs, the organic light emitting displays display images using organic light emitting diodes (OLED) that generate light by re-combination of electrons and holes. The organic light emitting display has high response speed and is driven with low power consumption.

The organic light emitting display includes pixels positioned at intersections of data lines and scan lines, a data driver for supplying data signals to the data lines, and a scan driver for supplying scan signals to the scan lines.

The scan driver sequentially supplies the scan signals to the scan lines. The data driver supplies the data signals to the data lines in synchronization with the scan signals.

The pixels are selected when the scan signals are supplied to the scan lines to receive the data signals from the data lines. A pixel that receives a data signal charges a voltage corresponding to a difference between the data signal and a first power supply in a storage capacitor. Then, the pixel supplies current corresponding to the voltage charged in the storage capacitor from the first power supply to a second power supply via an organic light emitting diode (OLED) to generate light with predetermined brightness.

SUMMARY

One inventive aspect is a pixel capable of minimizing power consumption and an organic light emitting display using the same.

Another aspect is a pixel, including an organic light emitting diode (OLED), a first transistor for controlling an amount of current supplied from a first power supply to the OLED to correspond to a voltage applied to a first node, and a second transistor and a third transistor coupled between a second node electrically coupled to a data line and the first node in parallel in a period where a scan signal is supplied.

The second transistor is coupled in the form of a diode so that current may flow from the first node to a second node. The third transistor is coupled in the form of a diode so that current may flow from the second node to the first node. The second transistor is coupled between the first node and the second node and has a gate electrode coupled to the second node. The third transistor is coupled between the first node and the second node and has a gate electrode coupled to the first node. The pixel further includes a fourth transistor coupled between the second node and the data line and is turned on when the scan signal is supplied, a storage capacitor coupled between the first node and the first power supply, and a fifth transistor that is coupled between the first transistor and the OLED and whose turn on period does not overlap the turn on period of the fourth transistor.

Another aspect is an organic light emitting display including a pixel unit including pixels positioned at intersections of scan lines, emission control lines, and data lines, a scan driver for supplying scan signals to the scan lines and for supplying emission control signals to the emission control lines, and a data driver for supplying an initializing voltage and data signals to the data lines. Each of the pixels includes an OLED, a first transistor for controlling an amount of current supplied from a first power supply to the OLED to correspond to a voltage applied to a first node, and a second transistor and a third transistor coupled between a second node electrically coupled to a data line and the first node in parallel in a period where a scan signal is supplied to a scan line.

The second transistor is coupled between the first node and a second node and has a gate electrode coupled to the second node. The third transistor is coupled between the first node and the second node and has a gate electrode coupled to the first node. Each of the pixels further includes a fourth transistor coupled between the second node and the data line and turned on when the scan signal is supplied, a storage capacitor coupled between the first node and the first power supply, and a fifth transistor coupled between the first transistor and the OLED and turned on when an emission control signal is not supplied to an emission control line.

The scan driver supplies an emission control signal to an ith emission control line to overlap a scan signal supplied to an ith (i is a natural number) scan line. The emission control signal is set to have larger width than the scan signal. The data driver supplies the initializing voltage to data lines in a partial period of a period in which the scan signal is supplied and supplies the data signal in a remaining period. The initializing voltage is set to be lower than the data signal. The data driver supplies a data signal corresponding to a specific gray scale in a period where the scan signal is not supplied. The specific gray scale is an intermediate gray scale.

Another aspect is an organic light emitting display, including first pixels formed in an auxiliary region that displays a previously set image, second pixels formed in a main region that displays an image corresponding to an external input, a data driver for driving data lines coupled to the first pixels and the second pixels, and a scan driver for sequentially supplying scan signals to scan lines coupled to the first pixels and the second pixels and for sequentially supplying emission control signals to emission control lines. The first pixels and the second pixels have different circuit structures.

Each of the first pixels includes an OLED, a first transistor for controlling an amount of current supplied from a first power supply to the OLED to correspond to a voltage applied to a first node, and a second transistor and a third transistor coupled between a second node electrically coupled to a data line and the first node in parallel in a period where a scan signal is supplied to a scan line. The second transistor is coupled between the first node and a second node and has a gate electrode coupled to the second node. The third transistor is coupled between the first node and the second node and has a gate electrode coupled to the first node. Each of the first pixels further includes a fourth transistor coupled between the second node and the data line and turned on when the scan signal is supplied, a storage capacitor coupled between the first node and the first power supply, and a fifth transistor coupled between the first transistor and the OLED and turned on when an emission control signal is not supplied to an emission control line.

An initializing voltage is supplied to the data lines in a partial period of a period in which scan signals are supplied to the first pixels. Data signals are supplied to the data lines in a remaining period. The initializing voltage is set as a lower voltage than the data signal. The data driver supplies a data signal corresponding to a specific gray scale in a period where the scan signal is not supplied. The specific gray scale is an intermediate gray scale. The specific gray scale is an average gray scale of data items supplied to the auxiliary region. Data signals are supplied to the second pixels k (k is a natural number) times and data signals are supplied to the first pixels j (j is a natural number smaller than k) times in a period of one second.

DETAILED DESCRIPTION

Figure 1:
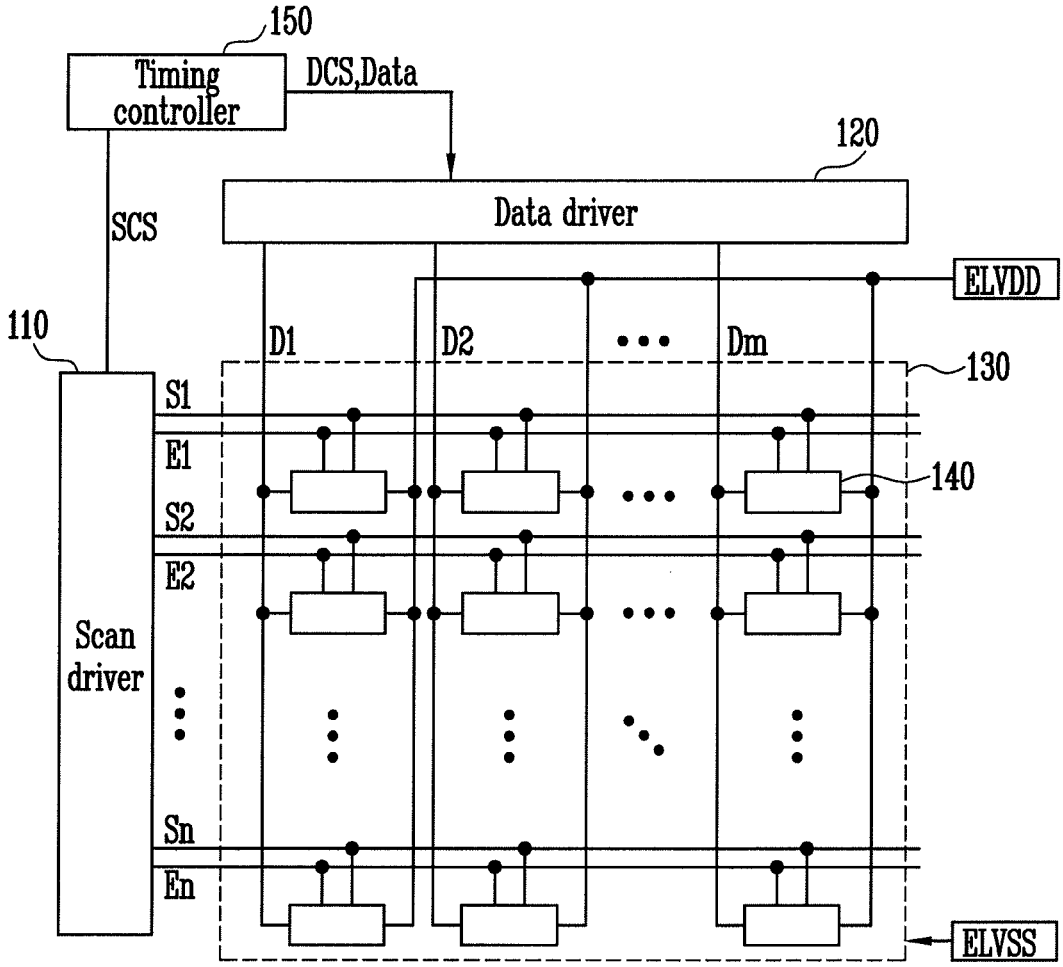
FIG. 1 is a view illustrating an organic light emitting display according to an embodiment.

Generally, in order to realize uniform brightness, an OLED storage capacitor must stably maintain its charged voltage. However, in conventional pixels (not necessarily prior art), in order to compensate for the threshold voltage of a driving transistor, a plurality of transistors are added so that at least two leakage paths are formed from the storage capacitor. Therefore, a driving frequency is increased to recharge the data signal in the storage capacitor in a short period. However, when the driving frequency is high, power consumption increases.

Organic light emitting displays are used for various portable apparatuses due to advantages of high color reproducibility and small thickness. A portable apparatus is divided into a main region for realizing an image and an auxiliary region for displaying icons. Thus, in order to stably charge the data signal, an auxiliary region that displays only determined information is driven at the same driving frequency as the main region so that power consumption increases.

Hereinafter, embodiments will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 is a view illustrating an organic light emitting display according to an embodiment.

Referring to FIG. 1, the organic light emitting display includes a pixel unit 130 including pixels 140 positioned at the intersections of scan lines S1 to Sn and data lines D1 to Dm, a scan driver 110 for driving the scan lines S1 to Sn and emission control lines E1 to En, a data driver 120 for driving the data lines D1 to Dm, and a timing controller 150 for controlling the scan driver 110 and the data driver 200.

The timing controller 150 generates a data driving control signal DCS and a scan driving control signal SCS to correspond to synchronizing signals supplied from the outside. The data driving control signal DCS generated by the timing controller 150 is supplied to the data driver 120 and the scan driving control signal SCS generated by the timing controller 150 is supplied to the scan driver 110. The timing controller 150 supplies data Data supplied from the outside to the data driver 120.

The scan driver 110 receives the scan driving control signal SCS from the timing controller 150. The scan driver 110 that receives the scan driving control signal SCS generates scan signals and sequentially supplies the generated scan signals to the scan lines S1 to Sn. In addition, the scan driver 110 generates emission control signals in response to the scan driving control signal SCS and sequentially supplies the generated emission control signals to the emission control lines E1 to En. Here, the width of the emission control signals is set to be substantially equal to or wider than the width of the scan signals. The emission control signal supplied to an ith (i is a natural number) emission control line Ei at least partially overlaps with the scan signal supplied to an ith scan line Si.

The data driver 120 receives the data driving control signal DCS from the timing controller 150. The data driver 120 that receives the data driving control signal DCS supplies an initializing voltage Vint to the data lines D1 to Dm in a partial period of a period in which the scan signals are supplied and supplies the data signals in a remaining period. Here, the initializing voltage is set as a voltage lower than the data signals. In addition, the data driver 120 supplies a voltage among the data signals, for example, a voltage corresponding to an intermediate gray scale to the data lines D1 to Dm in a period between frames, which will be described later in detail.

The pixel unit 130 receives a first power supply ELVDD and a second power supply ELVSS from the outside to supply the first power supply ELVDD and the second power supply ELVSS to the pixels 140. The pixels 140 that receive the first power supply ELVDD and the second power supply ELVSS control the amount of current that flows from the first power supply ELVDD to the second power supply ELVSS via an organic light emitting diode (OLED) to correspond to the data signals.

Figure 2:
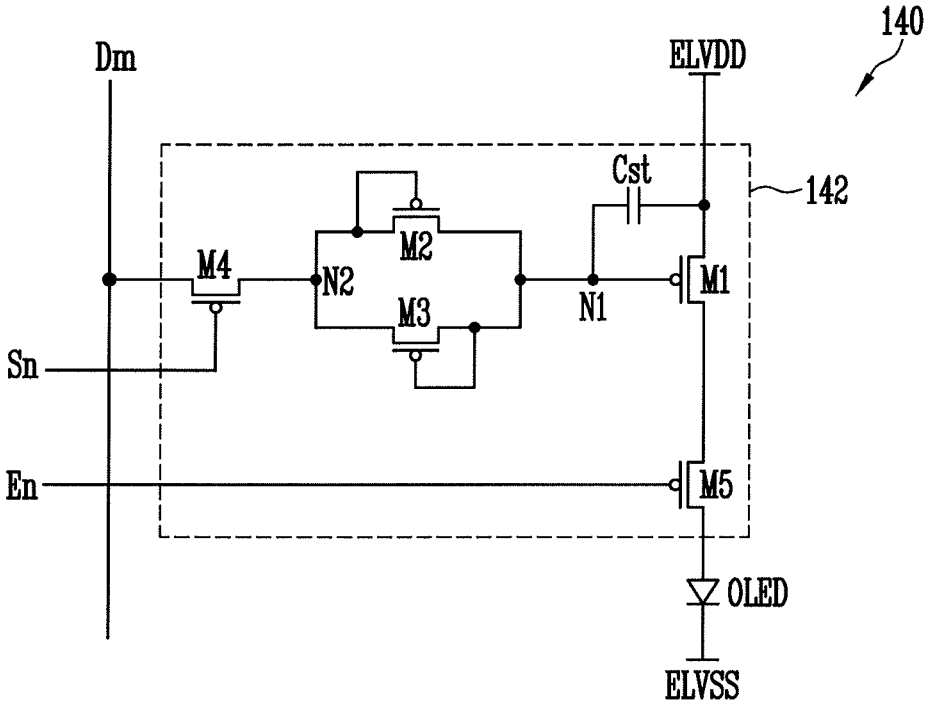
FIG. 2 is a circuit diagram illustrating a pixel according to an embodiment.

FIG. 2 is a circuit diagram illustrating a pixel according to an embodiment. In FIG. 2, for convenience sake, the pixel coupled to the mth data line Dm and the nth scan line Sn will be illustrated.

Referring to FIG. 2, the pixel 140 includes an organic light emitting diode (OLED) and a pixel circuit 142 coupled to the data line Dm, the scan line Sn, and the emission control line En to control the amount of current supplied to the OLED.

The anode electrode of the OLED is coupled to the pixel circuit 142 and the cathode electrode of the OLED is coupled to the second power supply ELVSS. Here, the second power supply ELVSS is set to have a lower voltage than the first power supply ELVDD. The OLED generates light with predetermined brightness to correspond to the amount of current supplied from the pixel circuit 142.

The pixel circuit 142 controls the amount of current supplied to the OLED to correspond to the data signal supplied to the data line Dm when a scan signal is supplied to the scan line Sn. Therefore, the pixel circuit 142 includes first to fifth transistors M1 to M5 and a storage capacitor Cst.

The first electrode of the first transistor M1 (or a driving transistor) is coupled to the first power supply ELVDD and the second electrode of the first transistor M1 is coupled to the first electrode of the fifth transistor M5. The gate electrode of the first transistor M1 is coupled to a first node N1. The first transistor M1 controls the amount of current supplied to the OLED to correspond to the voltage applied to the first node N1.

The second transistor M2 and the third transistor M3 are coupled between the first node and a second node N2 in parallel. The first electrode of the second transistor M2 is coupled to the first node N1 and the second electrode of the second transistor M2 is coupled to the second node N2. The gate electrode of the second transistor M2 is coupled to the second node N2. That is, the second transistor M2 is coupled in the form of a diode so that current may flow from the first node N1 to the second node N2.

The first electrode of the third transistor M3 is coupled to the second node N2 and the second electrode of the third transistor M3 is coupled to the first node N1. The gate electrode of the third transistor M3 is coupled to the first node N1. That is, the third transistor M3 is coupled in the form of a diode so that current may flow from the second node N2 to the first node N1.

The first electrode of the fourth transistor M4 is coupled to the data line Dm and the second electrode of the fourth transistor M4 is coupled to the second node N2. The gate electrode of the fourth transistor M4 is coupled to the scan line Sn. The fourth transistor M4 is turned on when the scan signal is supplied to the scan line Sn to electrically couple the data line Dm and the second node N2.

The first electrode of the fifth transistor M5 is coupled to the second electrode of the first transistor M1 and the second electrode of the fifth transistor M5 is coupled to the anode electrode of the OLED. The gate electrode of the fifth transistor M5 is coupled to the emission control line En. The fifth transistor M5 is turned off when an emission control signal is supplied and is turned on when the emission control signal is not supplied. When the fifth transistor M5 is turned on, the first transistor M1 and the OLED are electrically coupled to each other.

The storage capacitor Cst is coupled between the first node N1 and the first power supply ELVDD. The storage capacitor Cst charges a predetermined voltage to correspond to a voltage applied to the first node N1.

Figure 3:
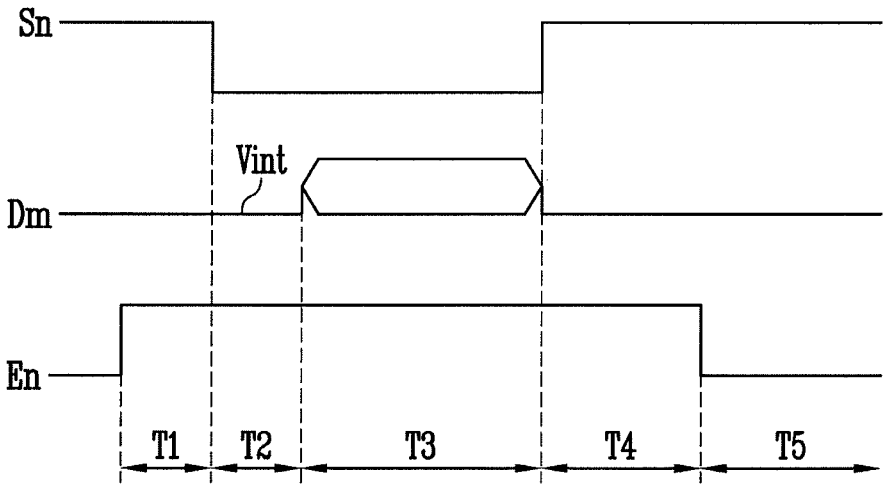
FIG. 3 is a waveform chart illustrating an embodiment of a method of driving the pixel illustrated in FIG. 2.

FIG. 3 is a waveform chart illustrating an embodiment of a method of driving the pixel illustrated in FIG. 2.

Referring to FIG. 3, an emission control signal is supplied to the emission control line En in a first period T1 to a fourth period T4 to substantially completely overlap with the scan signal supplied to the scan line Sn. When the emission control signal is supplied to the emission control line En, the fifth transistor M5 is turned off. When the fifth transistor M5 is turned off, coupling between the first transistor M1 and the OLED is blocked so that the OLED is set to be in a non-emission state.

Then, a scan signal is supplied to the scan line Sn in a second period T2 and a third period T3. An initializing voltage Vint is supplied to the data line Dm in the second period T2. When the scan signal is supplied to the scan line Sn, the fourth transistor M4 is turned on. When the fourth transistor M2 is turned on, the data line Dm and the second node N2 are electrically coupled to each other.

In this case, a data signal supplied in a previous period is applied to the first node N1 and the initializing voltage Vint is applied to the second node N2. Here, since the initializing voltage Vint is set as a sufficiently lower voltage than the data signal so that the first node N1 may be initialized, the second transistor M2 is turned on. When the second transistor M2 is turned on, the first node N1 is initialized to the initializing voltage Vint.

A data signal is supplied to the data line Dm in the third period T3. The data signal supplied to the data line Dm is supplied to the second node N2 via the fourth transistor M4. At this time, since the second node N2 is set as the voltage of the data signal and the first node N1 is set as the initializing voltage Vint, the third transistor M3 is turned on.

When the third transistor M3 is turned on, the voltage of the first node N1 is increased to a voltage obtained by subtracting the threshold voltage of the third transistor M3 from the voltage of the data signal. That is, the voltage of the data signal supplied to the second node N2 is supplied to the first node N1 via the third transistor M3 coupled in the form of a diode. Therefore, a voltage obtained by subtracting the threshold voltage of the third transistor M3 from the voltage of the second node N2 is applied to the first node N1.

Here, the third transistor M3 and the first transistor M1 formed in the same pixel are set to have substantially the same threshold voltage. Therefore, the voltage obtained by compensating for the threshold voltage of the first transistor M1 is applied to the first node N1 in the third period T3. The storage capacitor Cst stores the voltage applied to the first node N1.

Then, supply of the emission control signal to the emission control line En is stopped in a fifth period T2 so that the fifth transistor M5 is turned on. When the fifth transistor M5 is turned on, the first transistor M1 and the OLED are electrically coupled to each other. Then, current supplied from the first transistor M1 is supplied to the OLED to correspond to the voltage of the first node N1 so that light with predetermined brightness is generated by the OLED.

According to one embodiment, the above-described processes are repeated to generate predetermined light by the pixels 140. In one embodiment, leakage path is not formed between the first node N1 and the initializing power supply Vint so that the voltage charged in the first node N1 is stably maintained. Therefore, when the pixel 140 is applied, the driving frequency may be reduced so that power consumption may be reduced.

In addition, after the data signals are supplied to all of the pixels 140, for example, in a period between frames, the voltage corresponding to the intermediate gray scale may be applied to the data lines D1 to Dm. Then, the amount of leakage current that flows to the data line Dm via the first node N1, the second transistor M2, and the fourth transistor M4 may be minimized so that the voltage charged in the first node N1 may be stably maintained.

Figure 4:
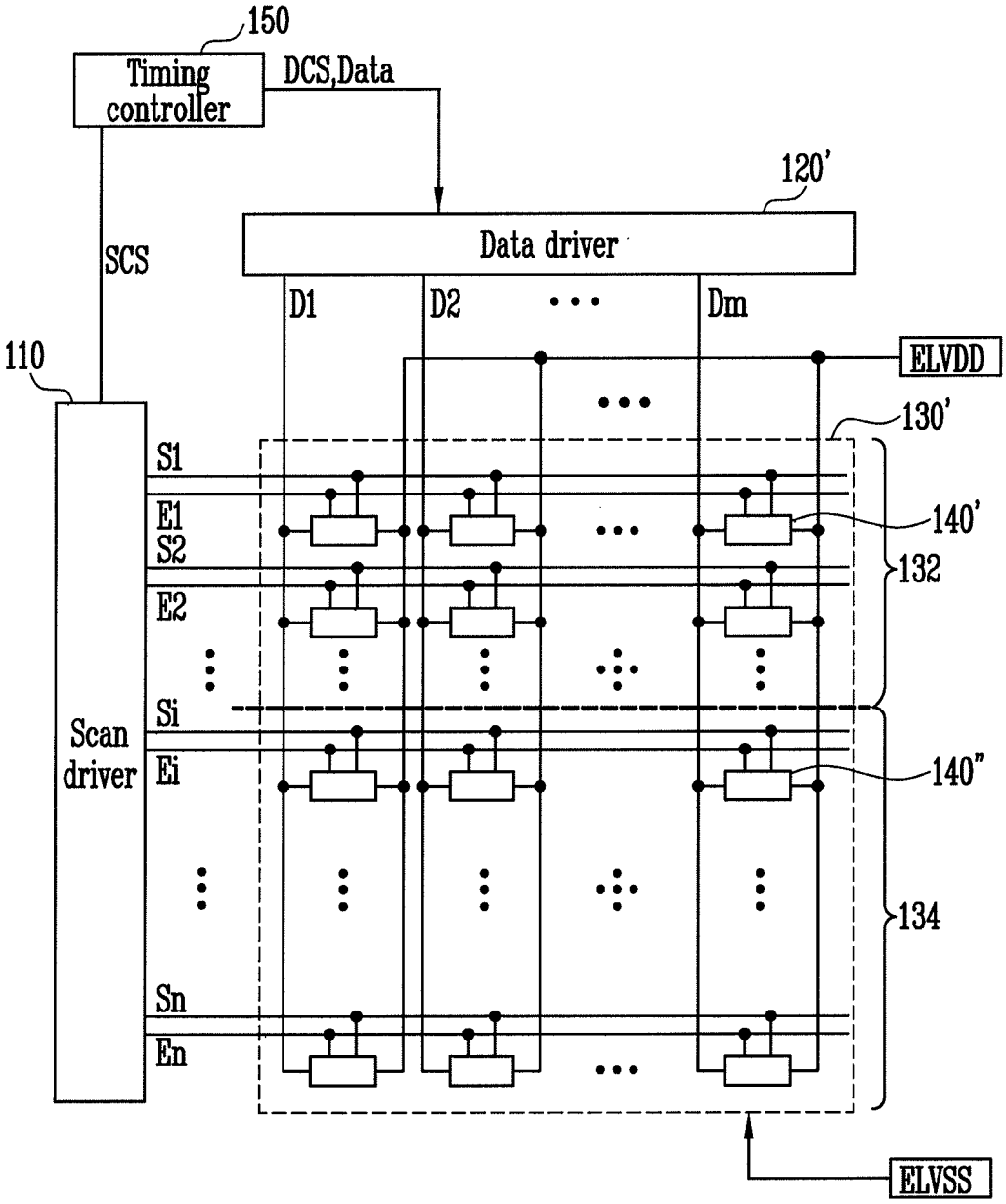
FIG. 4 is a view illustrating an organic light emitting display according to another embodiment.

FIG. 4 is a view illustrating an organic light emitting display according to another embodiment. In FIG. 4, the same elements as those of FIG. 1 are denoted by the same reference numerals and detailed description thereof will be omitted.

Referring to FIG. 4, a pixel unit 130' of an organic light emitting display includes an auxiliary region 132 and a main region 134. In the auxiliary region 132, previously set information such as icons and time is displayed. In the main region 134, a predetermined image is realized to correspond to an input of a user.

In the auxiliary region 132, as illustrated in FIG. 2, pixels 140' are formed. In one embodiment, in the main region 134, pixels 140" of currently well known various types are formed. That is, in another embodiment, the pixels 140' are formed in the auxiliary region 132 in order to minimize power consumption and the currently well known pixels 140" are formed in the main region 134 in order to secure stability of driving.

As described above, when the pixels are formed in the auxiliary region 132, the number of times of supply of data signals to the auxiliary region 132, that is, a driving frequency may be reduced so that power consumption may be reduced. For example, in a period of one second, data signals may be supplied to the pixels 140" of the main region 134 k times (k is a natural number) and data signals may be supplied to the pixels 140' of the auxiliary region 132 j times (j is a natural number smaller than k).

In addition, after the data signals are supplied to all of the pixels 140' and 140", for example, in a period between frame, the data driver 120' may supply a voltage of an intermediate gray scale or a gray scale corresponding to the average value of data items supplied to the auxiliary region 132 to the data lines D1 to Dm.

Actually, since only determined icons are displayed in the auxiliary region 132, data to be supplied to the auxiliary region 132 may be previously grasped. Therefore, the data driver 120 applies the voltage of the gray scale corresponding to the average value of the data items supplied to the auxiliary region 132 to the data lines D1 to Dm in a period where the data signals are not supplied to the auxiliary region 132 to minimize leakage current from the pixels 140'.

According to at least one of the disclosed embodiments, the voltage charged in the storage capacitor may be stably maintained so that power consumption may be reduced.

While the above embodiments have been described in connection with the accompanying drawings, it is to be understood that the present disclosure is not limited to the above embodiments, but, on the contrary, is intended to cover various modifications and equivalent arrangements included within the spirit and scope of the appended claims, and equivalents thereof.

What is claimed is:

1. A pixel, comprising:

an organic light emitting diode (OLED);

a first transistor configured to control an amount of current supplied from a first power supply to the OLED to correspond to a voltage applied to a first node;

a second transistor and a third transistor coupled between the first node and a second node in parallel in a period where a scan signal is supplied, wherein the second node is electrically coupled to a data line;

a fourth transistor coupled between the second node and the data line; and a fifth transistor coupled between the first transistor and the OLED, wherein the fifth transistor comprises a gate electrode, a first electrode and a second electrode, wherein the first and second electrodes of the fifth transistor are coupled only to the first transistor and the OLED, and wherein the first transistor is directly coupled to the first power supply and the fifth transistor, wherein the fourth transistor is configured to be turned on during a scan signal applying period when the scan signal is supplied, wherein a turn-on period of the fourth transistor does not overlap with a turn-on period of the fifth transistor, wherein the fifth transistor is configured to be turned off during an emission control signal applying period when an emission control signal is applied to the fifth transistor, wherein the scan signal applying period comprises a first period during which an initialization voltage is applied to the second transistor and a second period during which a single data signal is applied to the fourth transistor, and wherein the initialization voltage is lower than the single data signal.

2. The pixel as claimed in claim 1, wherein the second transistor is configured to flow current from the first node to the second node, and wherein the third transistor is configured to flow current from the second node to the first node.

3. The pixel as claimed in claim 1, wherein the second transistor has a gate electrode coupled to the second node, and wherein the third transistor has a gate electrode coupled to the first node.

4. The pixel as claimed in claim 1, further comprising:

a storage capacitor coupled between the first node and the first power supply.

5. An organic light emitting display, comprising:

a pixel unit including pixels positioned at intersections of scan lines, emission control lines, and data lines;

a scan driver configured to supply scan signals to the scan lines and supply emission control signals to the emission control lines; and a data driver configured to supply an initializing voltage and data signals to the data lines, wherein each of the pixels comprises:

an organic light emitting diode (OLED);

a first transistor configured to control an amount of current supplied from a first power supply to the OLED to correspond to a voltage applied to a first node;

a second transistor and a third transistor coupled between the first node and a second node in parallel in a period where a scan signal is supplied, wherein the second node is electrically coupled to one of the data lines;

a fourth transistor coupled between the second node and the one of the data lines; and a fifth transistor coupled between the first transistor and the OLED, wherein the fifth transistor comprises a gate electrode, a first electrode and a second electrode, wherein the first and second electrodes of the fifth transistor are coupled only to the first transistor and the OLED, and wherein the first transistor is directly coupled to the first power supply and the fifth transistor, wherein the fourth transistor is configured to be turned on during a scan signal applying period when the scan signal is supplied, wherein the fifth transistor is configured to be turned on when an emission control signal is not supplied to an emission control line, wherein the fifth transistor is configured to be turned off during an emission control signal applying period when an emission control signal is applied to the fifth transistor, wherein the scan signal applying period comprises a first period during which an initialization voltage is applied to the second transistor and a second period during which a single data signal is applied to the fourth transistor, and wherein the initialization voltage is lower than the single data signal.

6. The organic light emitting display as claimed in claim 5, wherein the second transistor has a gate electrode coupled to the second node, and wherein the third transistor has a gate electrode coupled to the first node.

7. The organic light emitting display as claimed in claim 5, wherein each of the pixels further comprises:

a storage capacitor coupled between the first node and the first power supply.

8. The organic light emitting display as claimed in claim 5, wherein the scan driver is configured to supply an emission control signal to an ith emission control line to at least partially overlap with a scan signal supplied to an ith (i is a natural number) scan line.

9. The organic light emitting display as claimed in claim 8, wherein the emission control signal is set to have a larger width than the scan signal.

10. The organic light emitting display as claimed in claim 5, wherein the data driver is configured to i) supply the initializing voltage to data lines in a partial period of a period in which the scan signal is supplied and ii) supply the data signal in a remaining period.

11. The organic light emitting display as claimed in claim 5, wherein the initializing voltage is set to be lower than the data signal.

12. The organic light emitting display as claimed in claim 5, wherein the data driver supplies a data signal corresponding to a specific gray scale in a period where the scan signal is not supplied.

13. The organic light emitting display as claimed in claim 12, wherein the specific gray scale is an intermediate gray scale.

14. An organic light emitting display, comprising:

a first plurality of pixels formed in an auxiliary region and configured to display a previously set image;

a second plurality of pixels formed in a main region and configured to display an image corresponding to an external input;

a data driver configured to drive data lines coupled to the first plurality of pixels and the second plurality of pixels; and a scan driver configured to sequentially supply scan signals to scan lines coupled to the first pixels and the second pixels and sequentially supply emission control signals to emission control lines, wherein the first plurality of pixels and the second plurality of pixels have different circuit structures, wherein each of the first plurality of pixels comprises:

an organic light emitting diode (OLED);

a first transistor configured to control an amount of current supplied from a first power supply to the OLED to correspond to a voltage applied to a first node;

a second transistor and a third transistor coupled between the first node and a second node in parallel in a period where a scan signal is supplied, wherein the second node is electrically coupled to a data line;

a fourth transistor coupled between the second node and the data line; and a fifth transistor coupled between the first transistor and the OLED, wherein the fifth transistor comprises a gate electrode, a first electrode and a second electrode, wherein the first and second electrodes of the fifth transistor are coupled only to the first transistor and the OLED, and wherein the first transistor is directly coupled to the first power supply and the fifth transistor, wherein the data driver is configured to supply a data signal corresponding to a specific gray scale in a period where the scan signal is not supplied, and wherein the specific gray scale is an average gray scale of data items supplied to the auxiliary region.

15. The organic light emitting display as claimed in claim 14, wherein the second transistor has a gate electrode coupled to the second node, and wherein the third transistor has a gate electrode coupled to the first node.

16. The organic light emitting display as claimed in claim 14, wherein each of the first plurality of pixels further comprises:

a storage capacitor coupled between the first node and the first power supply, wherein the fourth transistor is configured to be turned on when the scan signal is supplied, and wherein the fifth transistor is configured to be turned on when an emission control signal is not supplied to an emission control line.

17. The organic light emitting display as claimed in claim 14, wherein an initializing voltage is supplied to the data lines in a partial period of a period in which scan signals are supplied to the first plurality of pixels, and wherein data signals are supplied to the data lines in a remaining period.

18. The organic light emitting display as claimed in claim 17, wherein the initializing voltage is set as a lower voltage than the data signal.

19. The organic light emitting display as claimed in claim 14, wherein the specific gray scale is an intermediate gray scale.

20. The organic light emitting display as claimed in claim 14, wherein data signals are supplied to the second pixels k times (k is a natural number) and wherein data signals are supplied to the first pixels j times (j is a natural number smaller than k) in a period of one second.

* * * * *